US007498079B1

(12) United States Patent
Donckers

(10) Patent No.: US 7,498,079 B1
(45) Date of Patent: Mar. 3, 2009

(54) THERMALLY STABLE POLYTETRAFLUOROETHYLENE FIBER AND METHOD OF MAKING SAME

(75) Inventor: Mike Donckers, Decatur, AL (US)

(73) Assignee: Toray Fluorofibers (America), Inc., Decatur, AL (US)

( * ) Notice: Subject to any disclaimer, the term of this patent is extended or adjusted under 35 U.S.C. 154(b) by 0 days.

(21) Appl. No.: 11/763,249

(22) Filed: Jun. 14, 2007

Related U.S. Application Data

(60) Provisional application No. 60/943,759, filed on Jun. 13, 2007.

(51) Int. Cl.
*D02G 3/00* (2006.01)

(52) U.S. Cl. ..... 428/364; 426/394; 426/421

(58) Field of Classification Search ..... 428/364, 428/394, 421
See application file for complete search history.

(56) References Cited

U.S. PATENT DOCUMENTS 3,376,370 A * 4/1968 Koblitz et al. ..... 264/184
5,061,561 A 10/1991 Katayama
5,460,882 A 10/1995 Vita et al.
5,470,655 A 11/1995 Hirai
5,552,219 A 9/1996 Vita et al.
5,562,986 A 10/1996 Yamamoto et al.
5,562,987 A 10/1996 Shimizu
5,723,081 A * 3/1998 Blankenbeckler et al. ... 264/127
5,762,846 A * 6/1998 Blankenbeckler et al. ... 264/127
5,807,633 A 9/1998 Tamaru et al.
5,820,984 A * 10/1998 Blankenbeckler et al. ... 428/393
5,989,709 A 11/1999 Kelmartin, Jr. et al.
5,998,022 A 12/1999 Tamaru et al.
6,114,035 A 9/2000 Kelmartin, Jr. et al.
6,117,547 A 9/2000 Kelmartin, Jr. et al.
6,207,275 B1 3/2001 Heffner et al.
6,433,093 B2 8/2002 Lee et al.
6,667,097 B2 12/2003 Tokarsky et al.
6,841,243 B2 * 1/2005 Tokarsky et al. ..... 428/364
6,919,130 B2 7/2005 Tokarsky et al.
7,273,578 B1 * 9/2007 Slutsker et al. ..... 264/289.6
2003/0175513 A1 * 9/2003 Tokarsky et al. ..... 428/364
2004/0033364 A1 * 2/2004 Spiridigliozzi et al. ... 428/411.1
2004/0058152 A1 * 3/2004 Tokarsky et al. ..... 428/373
2004/0219358 A1 * 11/2004 Tokarsky et al. ..... 428/364

* cited by examiner

*Primary Examiner*—N. Edwards
(74) *Attorney, Agent, or Firm*—C. Brandon Browning; Maynard, Cooper & Gale, PC

(57) ABSTRACT

A dispersion spun polytetrafluoroethylene fiber exhibiting improved elongation prior to fiber break and increased thermal stability, the fiber prepared by forming a spin mix containing a dispersion of poly(tetrafluoroethylene) particles, forming an intermediate fluoropolymer fiber structure from the spin mix, sintering the intermediate fluoropolymer fiber structure and forming a continuous fluoropolymer filament yarn, drawing the continuous fluoropolymer filament yarn, and thereafter heat setting the continuous fluoropolymer filament yarn.

27 Claims, 2 Drawing Sheets

THERMALLY STABLE POLYTETRAFLUOROETHYLENE FIBER AND METHOD OF MAKING SAME

FIELD OF INVENTION

The present invention relates to a thermally stable fluoropolymer fiber and method of making same, and in particular to a thermally stable, dispersion spun polytetrafluoroethylene ("PTFE") fiber prepared by heat setting the fiber subsequent to drawing.

BACKGROUND OF INVENTION

Dispersion spun or wet PTFE yarns are typically produced by forming a spin mix containing an aqueous dispersion of poly(tetrafluoroethylene) particles and a solution of a cellulosic ether matrix polymer. The spin mix is then extruded at relatively low pressure (e.g., less than 150 pounds per square inch) through an orifice into a coagulation solution usually containing sulfuric acid to coagulate the matrix polymer and form an intermediate fiber structure. The intermediate fiber structure, once washed free of acid and salts, is passed over a series of heated rolls to dry the fiber structure and sinter the PTFE particles into a continuous PTFE filament yarn.

In order to increase PTFE yarn productivity and improve the yarn's functional properties (e.g., tenacity), the dried and sintered yarn is often drawn by accelerating the yarn speed over the last pair of heated rolls by passing the yarn onto a series of draw rolls having a rotational speed greater than the rotational speed of the heated rolls. Thus, the yarn is drawn or stretched over the last pair of heated rolls since it is being retrieved by the drawing rolls faster than it is being supplied by the heated rolls. The amount the yarn is drawn is referred to as the draw length or draw ratio. Typical draw ratios for a dispersion spun PTFE yarn range between 6.7 and 7.4, (i.e., the yarn is drawn to a length that is between 6.7 and 7.4 times greater than its pre-drawn length). After drawing, the yarn is wound into packages.

Although drawing PTFE yarn increases the tenacity of the yarn, it has the undesired effect of decreasing the yarn's thermal stability and elongation prior to break of the yarn. Accordingly, what is needed is a method of making a dispersion spun PTFE yarn that allows for increased productivity while maintaining or increasing yarn thermal stability and elongation prior to break of the yarn.

The primary benefit of maintaining or increasing yarn thermal stability in a dispersion spun PTFE yarn is centered in the hot gas filtration market. Because filter media made from PTFE yarn are exposed to and in continuous service in applications where air temperatures are regularly at or above 260 degrees Celsius, it is necessary to heat treat the PTFE yarn prior to putting it into service. When this step is accomplished standard yarns produced by dispersion spinning PTFE homopolymer shrink 20% or more. While the resulting shrunken PTFE yarn filter media performs well, it requires users to buy greater amounts of PTFE yarn to cover the loss of filter surface area caused by the shrinking.

SUMMARY OF INVENTION

Sintering a dispersion spun, intermediate PTFE fiber structure causes the PTFE particles in the structure to coalesce and entangle thus forming a continuous PTFE filament fiber. Drawing the continuous PTFE filament fiber causes elongation of the fiber and molecular alignment and orientation of the PTFE molecules to a degree. This situation causes internal stresses within the fiber created by overcoming the entanglement forces. Pursuant to the prior art, the continuous PTFE filament fiber is quickly cooled after drawing to below the Tg of PTFE (Tg of PTFE is approximately 320 to 350 degrees Celsius, depending on the molecular weight of the PTFE) in order to freeze or maintain the aligned molecules in place against these internal stresses and entanglement forces. It is believed that when such continuous PTFE filament fibers are later heated near or above the PTFE molecule's Tg, for example during hot gas filtration applications, the forces maintaining alignment of the PTFE molecules relax and are therefore overcome to an extent thus causing the fiber to shrink as the PTFE molecules resort to a less aligned state and orientation.

The present invention is based on the discovery that by modifying the draw scenario for a dispersion spun PTFE fiber yarn, the long established understanding that increasing the total draw of a PTFE yarn decreases yarn elongation prior to yarn break can be inverted while simultaneously increasing the yarn's thermal stability, (i.e., decreasing the amount the yarn shrinks at elevated temperatures.). According to the present invention, after a continuous PTFE filament fiber is formed by sintering, the fiber is drawn and the PTFE molecules aligned and held above the Tg of the PTFE molecules for a period of time. It is believed that by maintaining the drawn fiber at or above the Tg while the fiber is held at length relaxes the internal stresses within the fiber created by drawing. It is further believed that when the continuous PTFE filament fiber is later subjected to temperatures near or in excess of the Tg of the PTFE molecules, less shrinkage occurs since the internal stresses and entanglement forces of the fiber were previously relaxed. Thus, by drawing a sintered PTFE yarn and thereafter heat setting or heat stabilizing the drawn PTFE yarn there is provided a dispersion spun PTFE yarn exhibiting improved thermal stability and elongation prior to yarn break.

In one aspect of the invention there is provided a method a making a thermally stable PTFE fiber yarn that includes sintering the yarn by heating and passing it over a series of sintering rolls operating at 1× rotations/min., followed by cooling the yarn by passing it over a pair of drawings rolls operating at 1× rotations/min, followed by drawing the yarn by passing it between the drawing rolls and a series of heat setting rolls operating at 6× rotations/min, and lastly heat setting the yarn by passing it over the heat setting rolls operating.

In a further aspect of the invention there is provided a 400 denier PTFE fiber exhibiting less than 9% shrinkage when subjected to a temperature of 300 degrees Celsius for 30 minutes wherein the PTFE fiber is one or more of a multifilament fiber and a dispersion spun fiber.

In another aspect of the invention there is provided a 400 denier PTFE fiber exhibiting less than 15% shrinkage when subjected to a temperature of 300 degrees Celsius for 30 minutes wherein the PTFE fiber is one or more of a multifilament fiber and a dispersion spun fiber.

In yet another aspect of the invention there is provided a 1200 denier PTFE fiber exhibiting less than 5% shrinkage when subjected to a temperature of 300 degrees Celsius for 30 minutes wherein the PTFE fiber is one or more of a multifilament fiber and a dispersion spun fiber.

DETAILED DESCRIPTION OF DRAWINGS

Figure 1:
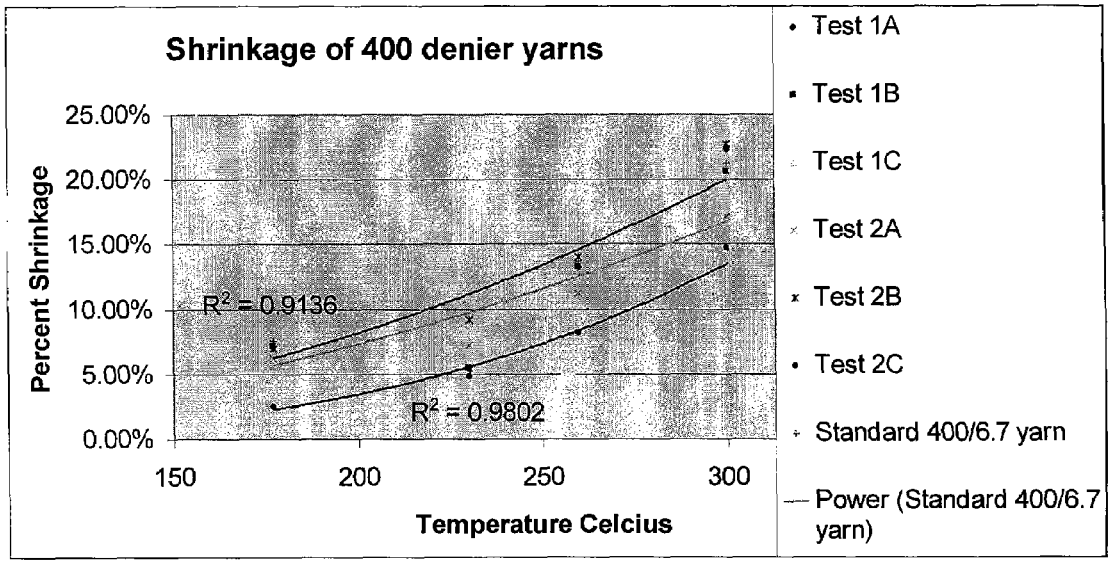
FIG. 1 is a graph illustrating the thermal stability of a number of 400 denier yarns prepared in accordance with the present invention.
Figure 2:
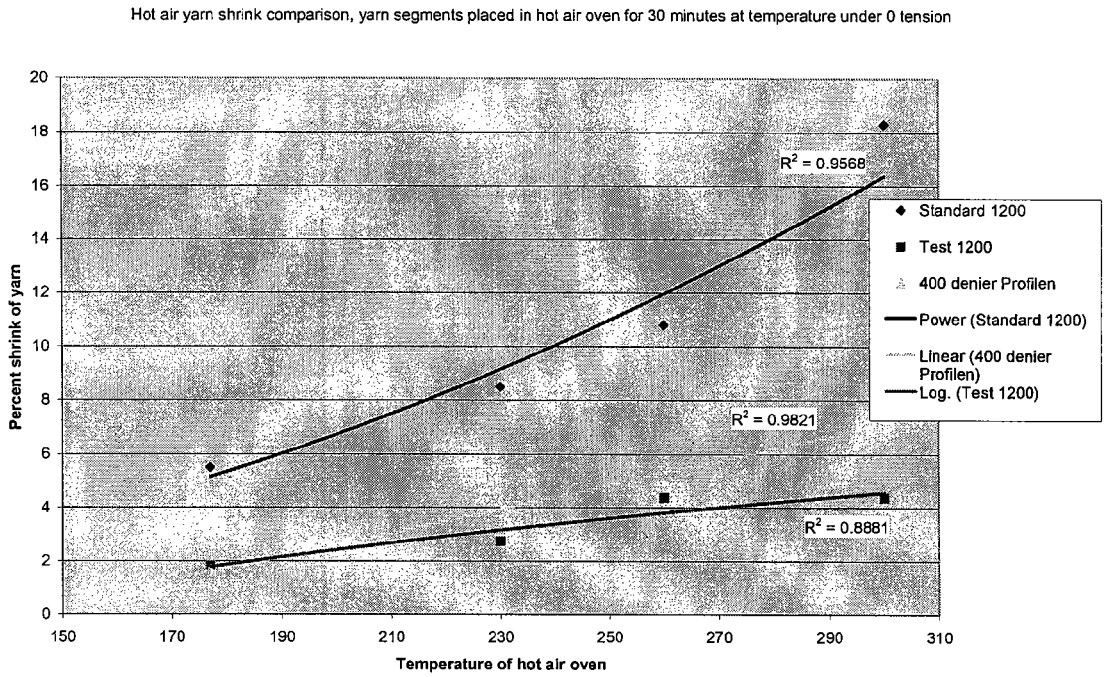
FIG. 2 is a graph illustrating the thermal stability of a number of 1200 denier yarns prepared in accordance with the present invention.

The present invention is directed to a dispersion spun fluoropolymer fiber that exhibits improved elongation prior to fiber break and increased thermally stability. By "dispersion spun" it is meant that the fiber is prepared by forming a dispersion of insoluble fluoropolymer particles, such as PTFE and polymers generally known as fluorinated olefinic polymers, and mixing the dispersion with a solution of a soluble matrix polymer to produce a spin mix. This spin mix is then coagulated into an intermediate fluoropolymer fiber structure by extruding the mixture into a coagulation solution in which the matrix polymer becomes insoluble.

One method which is commonly used to spin PTFE and related polymers includes spinning the polymer from a mixture of an aqueous dispersion of the polymer particles and viscose, where cellulose xanthate is the soluble form of the matrix polymer, as taught for example in U.S. Pat. Nos. 3,655,853; 3,114,672 and 2,772,444. Preferably, the fluoropolymer fiber of the present invention is prepared using a more environmentally friendly method than those methods utilizing viscose. One such method is described in U.S. Pat. Nos. 5,820,984; 5,762,846, and 5,723,081, which patents are incorporated herein in their entireties by reference. In general, this method employs a cellulosic ether polymer such as methylcellulose, hydroxyethylcellulose, methylhydroxypropylcellulose, hydroxypropylmethylcellulose, hydroxypropylcellulose, ethylcellulose or carboxymethylcellulose as the soluble matrix polymer, in place of viscose.

Once washed free of acid and salts, the intermediate fluoropolymer fiber structure is sintered and partially dried by heating the fiber and passing it over a series of sintering rolls operating at a temperature greater than the Tg of the PTFE molecules of the fiber. Sintering the structure coalesces and entangles the fluoropolymer particles, forming a continuous fluoropolymer filament fiber.

After sintering, the partially dried continuous fluoropolymer filament fiber is passed directly from the series of sintering rolls to a series of drawing rolls operating at ambient temperature. As a result, the continuous fluoropolymer filament fiber cools slightly, preferably about 30 degrees Fahrenheit, but remains in a transitional state.

After sintering, the continuous fluoropolymer filament fiber is drawn or elongated by passing the fiber directly from the series of drawing rolls to a series of heat setting rolls rotating at a speed greater than the series of sintering and drawing rolls. As a consequence, the continuous fluoropolymer filament fiber is accelerated and stretched between the next to last drawing roll and the first heat setting roll and slid across the last drawing roll resulting in the fiber undergoing drawing. Preferably, the series of heating rolls operate at a rotational speed that is approximately six times the rotational speed of the series of drawing rolls. This results in the fiber having a total draw ratio ranging from 6.7 to 7.4.

After drawing, the continuous fluoropolymer filament fiber is further dried and heat set or stabilized by passing the fiber over the series of heat setting rolls. The heat setting rolls operate at a temperature that is greater than the series of drawing rolls and essentially the same as the sintering rolls. As a consequence, the drawn continuous fluoropolymer filament fiber is heated and maintained at or near the temperature of the heat setting rolls for a period of time allowing the internal stresses created within the fiber by drawing to relax. After heat setting, the continuous fluoropolymer filament is wound and stored.

The present invention will be explained further in detail by the following Examples. In each of the Examples, the intermediate, cellulosic ether-based PTFE fiber structures were prepared in accordance with the method described in U.S. Pat. Nos. 5,820,984; 5,762,846, and 5,723,081 and subsequently processed. In one instance, the fiber structures were processed in accordance with the prior art and a number of 400 denier 6.7 denier per filament PTFE yarns were prepared and examined for comparing to PTFE yarns made in accordance with the present invention. In a further instance, the fiber structures were processed in accordance with the present invention and a number of 400 denier 6.7 denier per filament PTFE yarns were prepared and examined. In another instance, the fiber structures were processed in accordance with the present invention and a number of 1200 denier 6.7 denier per filament PTFE yarns were prepared and examined.

Unless otherwise indicated below, in each instance, the draw ratio, elongation prior to break, tenacity and shrinkage of the PTFE yarns were measured. All shrinkage data represent the average of 6 specimens placed in a calibrated oven under tension for 30 minutes. All tensile test data represent the average of 5 yarn breaks from each of 4 different bobbins. All pulls were performed on a calibrated instron tensile tester. Elongation prior to break was measured as break strength on an instron tensile tester.

More specifically with regard to tensile strength and elongation prior to break, a fiber section was pulled and force applied to the fiber using the instron tensile tester. Throughout the pull the amount of force applied to the fiber is measured. Tensile strength was determined by dividing the total pound force by the denier. The amount the fiber stretches prior to breaking is the elongation. For example, 6 inch lengths of fiber are pulled and tested. At break the fibers are 7.2 inches long. Thus, the amount of stretch is 1.2 inches. This amount is divided by the original length of 6 inches to provide the elongation prior to breaking of 0.20 or 20% elongation at break.

Control Yarn—400 Denier 6.7 Denier Per Filament Yarn Production with Standard Draw Scenario The intermediate PTFE fiber structure was prepared from a spin mix having a density of 1.275 grams per cubic centimeter. The fiber structure was then processed by heating it to a temperature about two times greater than the Tg of the PTFE molecules by passing it over a series of heated rolls. The resulting continuous PTFE filament yarn was passed directly to a series of drawing rolls operating at ambient temperature and rotating at a speed approximately six times greater than the rotational speed of the heated rolls.

The production conditions for the PTFE control yarn and aim finished yarn properties are described below.

| | |
|---|---|
| Spin mix ratio | 1.275 g/cc |
| draw ratio - single stage | 6.7 |
| Aim elongation | 22% |
| Typically achieved tenacity | 1.8 g/d |
| Aim Color "L" | 15.00 |
| Shrinkage at 177 dC | 7.58% |
| Shrinkage at 230 dC | 5.33% |
| Shrinkage at 260 dC | 13.67% |
| Shrinkage at 300 dC | 21.25% |

EXAMPLE 1

400 Denier 6.7 Denier Per Filament Yarn Production with Altered Draw Scenario

The following parameters were adjusted to determine there effect on tenacity and thermal stability: length of draw or total draw ratio, stage in the sintering process in which the yarn was drawn, addition of an annealing or heat setting step after the draw, and spin mix density. The test being described was performed on 400 denier 6.7 denier per filament yarns.

Six sets of conditions were tested and the results were positive. It was found that the long established relationship of increasing the total draw to decrease the elongation, and increasing the tenacity could be inverted while decreasing the amount the yarn shrinks at elevated temperatures by ~35%. Continuity of the altered draw scenarios was surprisingly good resulting in more production than expected. In all cases increasing the total draw by means of a two stage or early draw resulted in better continuity than an increased total draw ratio in the standard draw zone.

The test comprised 2 different spin mix ratios. They were 1.275 grams per cubic centimeter and 1.291 grams per cubic centimeter. 1.275 grams per cubic centimeter is considered a standard spin mix ratio and is used commercially on Teflon® yarns within a defined range. All test conditions labeled "1" were run at this spin mix ratio. 1.291 grams per cubic centimeter is considered a "PTFE rich" spin mix ratio and is not presently used commercially on Teflon® yarns within a defined range. All test conditions labeled "2" were run at this spin mix ratio.

The test was performed with 3 different draw scenarios resulting in 6 sample sets. The draw scenarios were denoted as A, B, and C, resulting in test condition 1A, 1B, 1C, 2A, 2B, and 2C. The "A" samples represent a standard draw scenario, but with an increased total draw. The "B" samples represent separating the total draw into 2 steps for instance drawing between a set of rolls, followed by heat setting on a second set of rolls, followed a second draw. This scenario had no merit. The "C" samples represent a draw scenario in accordance the present invention.

| Condition | | | |
|---|---|---|---|
| | Test 1A | Test 1B | Test 1C |
| Spin Mix ratio | 1.275 g/cc | 1.275 g/cc | 1.275 g/cc |
| First stage draw | 0.0 | 4.0 | 7.4 |
| Second stage draw | 7.4 | 1.85 | 0 |
| Total draw | 7.40 | 7.40 | 7.40 |
| Achieve elongation | 14.13% | 15.70% | 33.51% |
| Achieve tenacity | 1.8 g/d | 1.53 g/d | 1.12 g/d |
| Achieved color | 17.2 | 15.9 | 15.5 |
| Shrinkage at 177 dC | 7.17% | 5.92% | 1.67% |
| Shrinkage at 230 dC | 5.50% | 8.58% | 5.08% |
| Shrinkage at 260 dC | 13.25% | 13.25% | 3.58% |
| Shrinkage at 300 dC | 22.33% | 20.67% | 8.50% |
| Average bobbin size | 0.47 lbs | 1.6 lbs | 0.89 lbs |
| Percent PTFE in final yarn | 96.865 | 94.516 | 95.555 |
| | Test 2A | Test 2B | Test 2C |
| Spin Mix ratio | 1.291 g/cc | 1.291 g/cc | 1.291 g/cc |
| First stage draw | 0.0 | 4.0 | 7.4 |
| Second stage draw | 6.8 | 1.85 | 0 |
| Total draw | 6.80 | 7.40 | 7.40 |
| Achieve elongation | 14.36% | 16.18% | 20.74% |
| Achieve tenacity | 1.84 g/d | 1.76 g/d | 1.81 g/d |

-continued

| Condition | | | |
|---|---|---|---|
| Achieved color | 14.4 | 16.2 | 20.7 |
| Shrinkage at 177 dC | 6.25% | 7.00% | 2.50% |
| Shrinkage at 230 dC | 7.25% | 9.17% | 4.83% |
| Shrinkage at 260 dC | 11.25% | 14.00% | 8.17% |
| Shrinkage at 300 dC | 17.17% | 22.75% | 14.75% |
| Average bobbin size | 1.05 lbs | 1.25 lbs | 0.06 lbs |
| Percent PTFE in final yarn | 96.137 | 95.574 | 95.221 |

As the data shows, elongation was decreased as expected when the draw ratio was increased under standard draw conditions. However, under alternate draw scenarios the relationship was inverted and represented an unexpected result. The "B" test shows increased elongation at both draw scenarios while the "C" condition elongation result increases dramatically.

Tenacity was not positively affected in either of the spin mix scenarios. While tenacity is remains relatively unaffected under the 1.291 g/cc condition, significant strength so loss occurs at the standard 1.275 g/cc condition as the draw scenario diverges from the standard condition.

Thermal stability of the "C" samples was dramatically improved in both 1 and 2 test conditions. A graphical representation of achieved shrinkage is presented in FIG. 1.

Test 2—Production of a 1200 Denier 6.7 Denier Per Filament Yarn with an Early Draw Section and Heat Setting Prior to Winding.

This was the second test performed in the pursuit of creating a yarn with increased dimensional stability at elevated temperatures. This test resulted in the production of 420 pounds of 1200 denier 6.7 denier per filament fiber with a slightly reduced tenacity, improved denier uniformity, and dramatically improved dimensional stability at elevated temperatures.

During the test spin mix density was maintained at an output of 59.5 or 1.29 grams per cubic centimeter. The yarn was drawn at a rate of 6.2×. The test suffered a dispersion yield of less than 50% due to an unexplained spin mix density upset that lasted nearly 6 hours. The average bobbin size was 1.3 pounds.

Bobbins produced during test: Standard 1200 denier campaigns commonly produce 12000-15000 pounds of yarn with an average bobbin size of 5 pounds.

Tensile Properties

| 1200 denier tensile properties | | | |
|---|---|---|---|
| | W00843 | Test production | Aim |
| Tenacity | 1.57 | 1.25 | Min 1.5 |
| Std Dev | 0.08 | 0.11 | |
| Elongation | 28.54 | 57.76 | 32 |
| Std dev | 3.41 | 16.59 | |

Shrinkage of yarn at elevated temperatures was measured as follows: 200 millimeter lengths of yarn were measure and placed in a preheated, calibrated, hot air oven for 30 minutes and then measured. Percent shrink was then determined. A graphical representation of the results and test settings is shown at FIG. 4.

As will be apparent to one skilled in the art, various modifications can be made within the scope of the aforesaid description. Such modifications being within the ability of one skilled in the art form a part of the present invention and are embraced by the claims below.

Having set forth the nature of the present invention, what is claimed is:

1. A polytetrafluoroethylene fiber exhibiting less than 9% shrinkage when subjected to a temperature of 300 degrees Celsius for 30 minutes wherein the polytetrafluoroethylene fiber is a dispersion spun fiber.

2. The polytetrafluoroethylene fiber according to claim 1 wherein the fiber exhibits less than 4% shrinkage when subjected to a temperature of 260 degrees Celsius for 30 minutes.

3. The polytetrafluoroethylene fiber according to claim 1 wherein the fiber exhibits less than 5.5% shrinkage when subjected to a temperature of 230 degrees Celsius for 30 minutes.

4. The polytetrafluoroethylene fiber according to claim 1 wherein the fiber exhibits less than 2% shrinkage when subjected to a temperature of 177 degrees Celsius for 30 minutes.

5. The polytetrafluoroethylene fiber according to claim 1 exhibiting more than about 30% elongation prior to break of the polytetrafluoroethylene fiber.

6. The polytetrafluoroethylene fiber according to claim 1 wherein the fiber is in the range of 385 denier to 412 denier.

7. The polytetrafluoroethylene fiber according to claim 1 prepared by a process including sintering the polytetrafluoroethylene fiber, thereafter drawing the polytetrafluoroethylene fiber, and thereafter heat setting the polytetrafluoroethylene fiber.

8. The polytetrafluoroethylene fiber according to claim 7 wherein the process provides a total draw ratio for the polytetrafluoroethylene fiber of about 7.4.

9. A polytetrafluoroethylene fiber exhibiting less than 15% shrinkage when subjected to a temperature of 300 degrees Celsius for 30 minutes wherein the polytetrafluoroethylene fiber is a dispersion spun fiber.

10. The polytetrafluoroethylene fiber according to claim 9 wherein the fiber exhibits less than 9% shrinkage when subjected to a temperature of 260 degrees Celsius for 30 minutes.

11. The polytetrafluoroethylene fiber according to claim 9 wherein the fiber exhibits less than 5% shrinkage when subjected to a temperature of 230 degrees Celsius for 30 minutes.

12. The polytetrafluoroethylene fiber according to claim 9 wherein the fiber exhibits less than 3% shrinkage when subjected to a temperature of 177 degrees Celsius for 30 minutes.

13. The polytetrafluoroethylene fiber according to claim 9 prepared by a process including sintering the polytetrafluoroethylene fiber, thereafter drawing the polytetrafluoroethylene fiber, and thereafter heat setting the polytetrafluoroethylene fiber.

14. The polytetrafluoroethylene fiber according to claim 13 wherein the process provides a total draw ratio for the polytetrafluoroethylene fiber of about 7.4.

15. The polytetrafluoroethylene fiber according to claim 13 wherein the process achieves more than about 20% elongation prior to break of the polytetrafluoroethylene fiber.

16. The polytetrafluoroethylene fiber according to claim 13 prepared from a mixture having a spin mix density of about 1.275 gram per cubic centimeter.

17. The polytetrafluoroethylene fiber according to claim 14 wherein the fiber is in the range of 385 denier to 412 denier.

18. A polytetrafluoroethylene fiber exhibiting less than 5% shrinkage when subjected to a temperature of 300 degrees Celsius for 30 minutes wherein the polytetrafluoroethylene fiber is a dispersion spun fiber.

19. The polytetrafluoroethylene fiber according to claim 18 wherein the fiber exhibits less than 4.5% shrinkage when subjected to a temperature of 260 degrees Celsius for 30 minutes.

20. The polytetrafluoroethylene fiber according to claim 18 wherein the fiber exhibits less than 3% shrinkage when subjected to a temperature of 230 degrees Celsius for 30 minutes.

21. The polytetrafluoroethylene fiber according to claim 18 wherein the fiber exhibits less than 2% shrinkage when subjected to a temperature of 177 degrees Celsius for 30 minutes.

22. The polytetrafluoroethylene fiber according to claim 18 wherein the fiber exhibits more than about 40% elongation prior to break of the polytetrafluoroethylene fiber.

23. The polytetrafluoroethylene fiber according to claim 18 prepared by a process that provides a total draw ratio for the polytetrafluoroethylene fiber of about 6.7 or more.

24. The polytetrafluoroethylene fiber according to claim 18 prepared by sintering the polytetrafluoroethylene fiber, thereafter drawing the polytetrafluoroethylene fiber, and thereafter heat setting the polytetrafluoroethylene fiber.

25. The polytetrafluoroethylene fiber according to claim 5 further exhibiting a tenacity of about 1.12 g/d.

26. The polytetrafluoroethylene fiber according to claim 9 further exhibiting a tenacity of about 1.81 g/d, wherein the polytetrafluoroethylene fiber exhibits more than about 20% elongation prior to break of the polytetrafluoroethylene fiber.

27. The polytetrafluoroethylene fiber according to claim 22 further exhibiting a tenacity of about 1.25 g/d.

* * * * *